United States Patent [19]

Dunnington et al.

[11] 4,203,262

[45] * May 20, 1980

[54] ABRASIVE DRILL

[75] Inventors: Bruce W. Dunnington, Wilmington, Del.; William B. Gernert, St. Davids, Pa.

[73] Assignee: The Glennel Corporation, Chester Springs, Pa.

[ * ] Notice: The portion of the term of this patent subsequent to Dec. 12, 1995, has been disclaimed.

[21] Appl. No.: 908,704

[22] Filed: May 23, 1978

Related U.S. Application Data

[63] Continuation-in-part of Ser. No. 731,039, Oct. 8, 1976, abandoned.

[51] Int. Cl.[2] ..... B24D 17/00

[52] U.S. Cl. ..... 51/204; 51/206 NF; 51/309

[58] Field of Search ..... 51/204, 206 R, 206 NF, 51/207, 293, 298, 309; 175/329, 330, 409, 9; 408/145, 199, 704; 76/108 R, 108 A; 125/30 R, 36

[56] References Cited

U.S. PATENT DOCUMENTS

| | | | |
|---|---|---|---|
| 2,730,439 | 1/1956 | Houchins | 51/206 R |
| 2,772,524 | 12/1956 | Kopczynski | 51/293 |
| 3,295,941 | 1/1967 | Spellman | 51/309 X |
| 3,547,608 | 12/1970 | Kitazawa | 51/298 X |
| 3,626,644 | 12/1971 | Culper | 125/30 R |
| 3,640,027 | 2/1972 | Weiss | 51/206 R |
| 3,762,895 | 10/1973 | Keeleric | 51/293 X |
| 3,854,898 | 12/1974 | Whitney | 51/293 X |
| 4,128,971 | 12/1978 | Dunnington | 51/204 |

*Primary Examiner*—Gary L. Smith
*Attorney, Agent, or Firm*—Charles A. McClure

[57] ABSTRACT

An abrasive drill of small diameter or "micro" drill, on the order of tenths of a millimeter to about a millimeter in diameter, is provided with a concentric cored portion occupied by relatively non-abrasive material. The filled portion is small enough that during drill rotation all of the surface of a workpiece within the outline of the end of the drill is abraded sufficiently by some part of the rotating end of the drill to crumble away rather than leaving any solid core or large fragments of the workpiece. The drill composition comprises abrasive particles in a less abrasive metallic matrix. The drill is formed by deposition of matrix material entraining abrasive particles onto a taut filamentary mandrel. The mandrel may be metallic, such as copper wire or may be non-metallic, such as nylon or other synthetic polymeric textile fiber composition.

12 Claims, 8 Drawing Figures

ABRASIVE DRILL

This is a continuation-in-part of our copending application, Ser. No. 731,039 filed Oct. 8, 1976, to be abandoned.

This invention relates to abrasive drills of small diameter.

Conventional core drills or drill bits are hollow cylindrical members having abrasive or cutting members variously distributed on or in the tubular structure, as in Boehm et al. U.S. Pat. No. 3,144,912 and Smith U.S. Pat. No. 1,641,206, for example, having one end surface essentially entirely available for rotational contact with a work surface. The core reduces the lateral drilling thickness and permits the injection of coolant or lubricant, resulting in increased drill life and improved economy of operations. However, especially in small sizes, the complementary rodlike portion being removed from the workpiece often breaks into pieces large enough to jam the drill, thereby forfeiting the advantages of open core drilling.

Grinding wheels may be made in cup shape, with open centers, as in de Paoli U.S. Pat. No. 3,171,236 for endwise presentation to the workpiece, or in solid cylindrical form so that the circumferential portion constitutes the abrading surface, as in Kitazawa U.S. Pat. No. 3,547,608. Neither of these common grinding devices can function as a drill, especially on a "micro" scale, such as a millimeter or so in diameter.

A primary object of the present invention is provision of a small-diameter or "micro" abrasive drill with a filled cored portion that extends its usability to smaller dimensions than feasible in conventional core drills.

Another object of this invention is provision of a concentric solid cored abrasive drill that disintegrates the entire portion of material being removed from a workpiece by means of such drill.

A particular object is provision of an abrasive drill on the order of a millimeter or less in diameter formed suitably about a concentric solid core of abrasive-free material.

A further object of the present invention is a method of forming such drills.

Other objects of the present invention, together with means and methods for attaining the various objects, will be apparent from the following description and the accompanying diagrams, which are presented by way of example rather than limitation. All views are larger than actual size.

In general, the objects of the present invention are accomplished via a cylindrical drill having an abrasive-containing metallic matrix portion surrounding a solid cored portion that is concentric therewith and with the longitudinal cylinder axis. The drill composition comprises abrasive particles distributed throughout a less abrasive matrix, and the cored portion comprises relatively non-abrasive material.

The drill is formed by electrical or chemical deposition of matrix material entraining abrasive particles onto a taut filamentary mandrel, which preferably comprises a round filament concentric with the longitudinal axis of the drill. The filament may be metallic, such as copper wire, or may be non-metallic, such as nylon or other synthetic polymeric textile fiber composition. The deposition step forms the cylindrical drill outline to the desired diameter, which may be on the order of a millimeter or so or tenths thereof.

Figure 1:
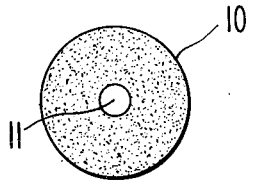
FIG. 1 is an end elevation of a first embodiment of abrasive drill according to this invention, having a filled cored portion with the configuration of a simple cylinder (round transverse cross-section) concentric with the longitudinal axis of the drill.

FIG. 1 shows an end (round) of drill 10 having as a core mandrel simple cylindrical filament 11 concentric with the longitudinal axis of the drill (in this view, the center of the end).

Figure 2:
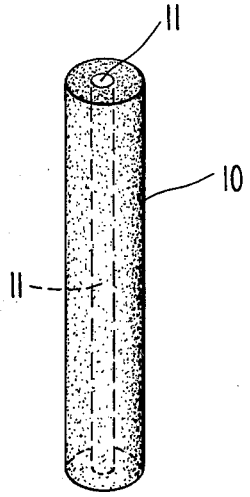
FIG. 2 is a perspective view of the drill of FIG. 1, with a broken-line showing of the simple cylindrical cored portion inside.

FIG. 2 shows drill 10 of FIG. 1 in perspective, with cored portion 11 shown in broken lines (inside) as a straight cylinder concentric with the drill axis.

Although a round filament has been disclosed for forming the drill mandrel, it is noteworthy that taut non-round filaments can be used instead, being produced by drawing of metal through suitably shaped dies or extrusion of fiber-forming compositions through correspondingly shaped spinnerets. Examples of cylindrical filaments with stylized triangular and square transverse cross-sections, respectively, that are useful as such mandrels are illustrated in subsequent views.

Figure 3:
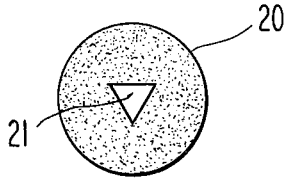
FIG. 3 is an end elevation of a second embodiment of cored drill according to this invention, in which the concentric core has the configuration of a cylinder with a triangular transverse cross-section.
Figure 4:
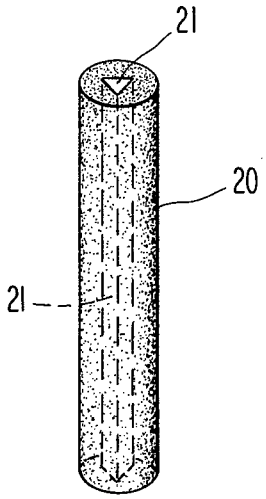
FIG. 4 is a perspective view of the drill of FIG. 3, with a broken-line showing of the triangular cylindrical cored portion inside.

FIGS. 3 and 4 show a second embodiment of the abrasive drill of this invention, end-on and in perspective. In this drill 20, cored portion 21 (shown in broken lines inside in FIG. 4) is a straight cylinder having a triangular transverse cross-section located concentric with the drill axis.

Figure 5:
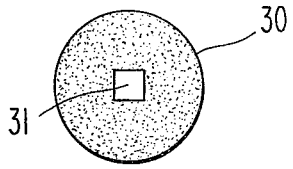
FIG. 5 is an end elevation of a third embodiment of cored drill according to this invention, in which the concentric core has the configuration of a cylinder with a square cross section.
Figure 6:
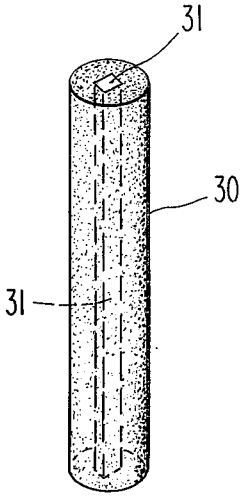
FIG. 6 is a perspective view of the drill of FIG. 5, with a broken-line showing of the square cylindrical cored portion inside.

FIGS. 5 and 6 show a third embodiment of the drill of this invention. Here drill 30 has cored portion 31 (shown in broken lines in FIG. 6) in straight cylindrical form having a square transverse cross-section while remaining concentric with the drill axis.

Although the respective cored portions are concentric with the drill axis they are so small that drills with such cores will not leave undisintegrated portions of a workpiece but will abrade essentially all the surface thereof within the outline of the rotating end of such drill. The filled core wears more rapidly than the drill body, to provide the configuration shown in subsequent views.

Figure 7:
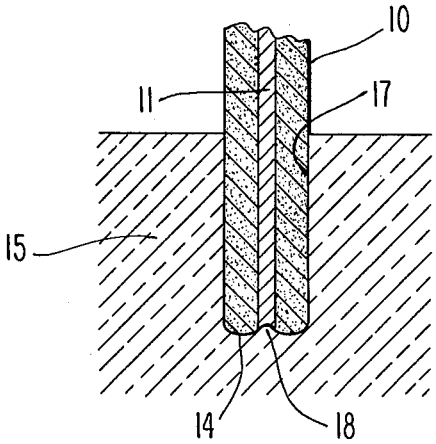
FIG. 7 is a sectional elevation, greatly enlarged, through the longitudinal axis of the drill of the preceding views and through a workpiece being drilled thereby.
Figure 8:
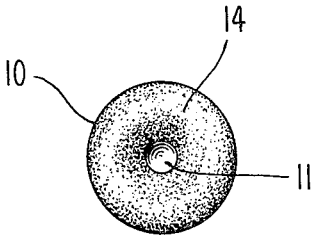
FIG. 8 is an end elevation of the same drill, further enlarged, after use in drilling a workpiece as in FIG. 7.

FIG. 7 shows in section how the drills of this invention wear curvilinearly both at the peripheral edge of the drilling end and at the central core, producing a doubly undulating transverse outline across the drill end and producing a mating outline of drilled aperture in the workpiece. The drill of FIGS. 1 and 2 is illustrated, but those of the other views wear similarly. The resulting end configuration of the drill appears end-on in FIG. 8. Thus, drill 10 has its peripheral edge rounded convexly and has cored portion 11 rounded concavely, leaving convex ring 14 surrounding the latter. Workpiece 15 is complementarily rounded to provide convexly rounded central protuberance 18 at the bottom of cylindrical hollow 17 produced by the drilling action. This aids in centering the drill, thereby precluding axial distortion such as might tend to bend or break the drill.

In summary, the drills of this invention are made possible by first selecting, arranging, and tautening the mandrel filament. The filament may be extended by heating, be gripped at its extended length (i.e., taut), and be cooled to tension it. Any filament may be heated externally, and metallic filaments may be resistance-heated by passing electrical current therethrough. Suitable filament diameter is from about one-twentieth to one-third the desired diameter of the resulting drill.

Then, the mandrel receives abrasive particles entrained in an electrically conductive matrix material to form the drill (to the desired diameter). Electroforming is readily carried out by deposition from a nickel solution in which the abrasive particles are suspended or at least circulating. As an alternative to cathodic deposition, electroless chemical reduction may be employed. Such techniques are well known in the art, and as their details need be merely conventional they will not be specified here. When electrically non-conductive mandrel materials are employed they can be coated with graphite or conductive adhesive materials to assist in the deposition process. However, adhesive binding of the abrasive particles to one another, as often used in grinding wheels or the like, is not feasible in the drills of this invention, which preferably should be electrodeposited or alternatively be deposited by chemical reduction to have the structural integrity essential to these micro-drills. With any cylindrical mandrel, uniform access of abrasive thereto is provided to locate the core concentrically as desired in a resulting simple cylindrical (round cross-section) drill.

The abrasive particles may be diamond, cubic boron nitride, alumina, tungsten carbide, or other recognized abrasives, such as oxides, carbides, or nitrides. Diamond is preferred because of its superior hardness and ready availability in desired size range. Cubic boron nitride is also very hard and, being more resistant to reaction with carbide-forming metals, is useful in drilling metals, such as tool steel.

The drills of this invention are most useful in drilling non-metals, usually hard brittle materials, such as ceramics and gemstones (both artificial and natural), which are difficult to drill by other means and methods and which tend to crumble when abraded. The smallness of the transverse cross-section of the concentric core in such drills ensures that such materials being drilled do not leave any central undrilled fragments, as lateral abrasion by the uniformly abrasive drill body throughout (including at the interface with the cored portion) crumbles the axial fragments.

A suitable range of particle size is from about a ten-thousandth to nearly half of the drill diameter. Thus, for a drill one or two millimeters in diameter, such particles could range from about one-tenth to one thousand microns in "diameter" and preferably from about 30 to 300 microns. Practical diameters for "micro" drills of this invention are on the order of a millimeter or so or even tenths of a millimeter.

The matrix material may comprise metal, cobalt, chromium, or alloys thereof or other similarly suitable metallic material. therein. It should effectively "lock" the entrained or occluded abrasive particles in place and be structurally strong enough to withstand the forces applied during drilling. Although hard, the matrix will be considerably softer than the abrasive particles themselves so as to wear away continually to expose them for drilling.

Although certain embodiments of this invention have been illustrated and described, other modifications may be made, as by adding, combining, or subdividing parts or steps, or by substituting equivalents, while retaining advantages and benefits of the invention, which itself is defined in the following claims.

We claim:

1. A cylindrical micro-drill having a diameter on the order of tenths of a millimeter to about a millimeter in extent, comprising a solid non-abrasive filamentary cored portion concentric with the longitudinal axis of the drill, and a surrounding solid contiguous portion disposed concentrically about the solid cored portion and comprising abrasive particles in a metallic matrix.

2. Abrasive drill according to claim 1, wherein the greatest transverse dimension of the solid cored portion is between about one-twentieth and one-third of the drill diameter.

3. Abrasive micro-drill according to claim 1, wherein the abrasive particles are distributed throughout the matrix, having been entrained therein when the matrix was deposited in place about the cored portion.

4. Abrasive micro-drill according to claim 1 or 3, wherein the abrasive particles are contained in a chemically deposited matrix.

5. Method of forming a cylindrical drill of at most about one millimeter diameter, comprising providing a taut filamentary mandrel concentric with the intended longitudinal axis of the drill and being in lateral extent from about one-twentieth to one-third of the intended drill diameter, and depositing metallic matrix material containing abrasive particles entrained therein uniformly onto the filamentary mandrel to obtain a cylindrical drill body contiguous therewith and extending to the intended diameter.

6. Method of drill formation according to claim 5, wherein the matrix material is electrodeposited onto the filamentary mandrel.

7. Method of drill formation according to claim 5, wherein the matrix material is deposited onto the filamentary mandrel by electroless chemical reduction.

8. Method of forming a cylindrical drill, comprising the steps of heating a filament to extend it, gripping the filament taut at its extended length, and cooling the filament to tension it; suspending abrasive particles in a fluid metallic composition, depositing the metallic composition onto the taut filament with abrasive particles entrained therein; and thereby forming a cylindrical abrasive drill.

9. Method of drill formation according to claim 8, wherein the filament is heated externally.

10. Method of drill formation according to claim 8, wherein the filament is metallic and is heated by passing an electric current therethrough.

11. Method of drill formation according to claim 8, including the steps of limiting the resulting drill diameter to from about three to twenty times the diameter of the filament.

12. Method of drill formation according to claim 11, including limiting the drill diameter to at most about a millimeter.

* * * * *